US005701698A

United States Patent [19]

Wesp et al.

[11] Patent Number: 5,701,698

[45] Date of Patent: Dec. 30, 1997

[54] TRIGGER MECHANISM FOR FIREARMS

[75] Inventors: Horst Wesp; Peter Dallhammer, both of Ulm, Germany

[73] Assignee: Carl Walther GmbH, Ulm, Germany

[21] Appl. No.: 627,225

[22] Filed: Feb. 23, 1996

[30] Foreign Application Priority Data

Mar. 1, 1995 [DE] Germany ..... 195 07 052.6

[51] Int. Cl.[6] ..... F41A 19/35

[52] U.S. Cl. ..... 42/69.02

[58] Field of Search ..... 42/69.02; 89/147, 89/154, 149, 150

[56] References Cited

U.S. PATENT DOCUMENTS

| | | | |
|---|---|---|---|
| 3,678,800 | 7/1972 | Seidel et al. | 89/147 |
| 4,155,187 | 5/1979 | Lichtman | 89/147 |
| 5,050,480 | 9/1991 | Knight, Jr. et al. | 89/147 |
| 5,386,659 | 2/1995 | Vaid et al. | 42/69.02 |
| 5,502,914 | 4/1996 | Moon | 42/69.02 |

FOREIGN PATENT DOCUMENTS

| | | | |
|---|---|---|---|
| 605729 | 4/1932 | Germany | 89/147 |

OTHER PUBLICATIONS

English translation of German pat. no. 605,729.

*Primary Examiner*—Stephen M. Johnson

*Attorney, Agent, or Firm*—Edmund M. Jaskiewicz

[57] ABSTRACT

In a hammerless automatic pistol with double-action and single-action functions there are provided between the trigger arm and firing pin of the trigger mechanism a catch pawl for the firing pin and a support lever that maintains the catch pawl in the catch position. During double-action operation, both of these intermediate components are disengaged but they are engaged for single-action function. The engagement and disengagement of these intermediate components is performed automatically during the shooting cycle. By merely removing one or both of these intermediate components the automatic pistol can be modified for double-action only trigger function, in which the firing pin is simultaneously cocked and released for firing during each shot by actuating the trigger.

18 Claims, 10 Drawing Sheets

TRIGGER MECHANISM FOR FIREARMS

FIELD OF ART

The present invention relates to a trigger mechanism for hammerless firearms, more particularly, to such a trigger mechanism in automatic pistols having an axially displaceable spring loaded firing pin that interacts with a trigger arm of the trigger mechanism during double-action operation.

BACKGROUND OF THE INVENTION

Known hammerless automatic pistols operate either only with single-action or only with double-action function or with intermediate positions thereof as, for example, disclosed in EP-PS 77 790.

In WO-OS 91/09264 there is disclosed a hammerless automatic pistol of the above-mentioned type that provides only a double-action function. In such a double-action function, the firing pin is cocked by the initial actuation of the trigger and after the trigger is further actuated further along its path the firing pin is automatically released to fire the shot. To carry out this function, the firing pin is provided with a pivotable driver on which a trigger arm comes to rest and which cocks the firing pin against the force of a firing pin spring. At the end of the path of the trigger, the trigger arm is deflected downwardly by a control cam such that the cocked firing pin is released for firing. The breech block of the automatic pistol that travels backward and again forward due to the recoil cannot cock the firing pin since the connection between a trigger arm and the firing pin remains interrupted as long as the trigger, or trigger finger, is depressed. Only when the trigger has been returned to its forward most position will the pivoted trigger arm again be released upwardly until it can engage from behind the driver of the uncocked firing pin for the next cocking procedure.

In known Hammerless automatic pistols having a single-action function, the firing pin is cocked by the backward-moving or forward-moving breech and is maintained in the cocked position with the help of a catch pawl. The movement of the breech block may be performed either automatically by the recoil or manually by pulling back on the breech block against the force of the breech block spring. By actuating the trigger, the catch pawl is released and the firing pin is released for firing.

In contrast to known Hammerless automatic pistols, most automatic pistols are provided, in addition to the firing pin, with a firing hammer that strikes the firing pin and drives it forward to fire the cartridge. Such known automatic pistols generally operate with double-action and with single-action function. During double-action function, the firing hammer is cocked for the first shot by the initial actuation of the trigger and after the trigger is pulled further along the trigger path the firing hammer is then released for firing. After successful firing of the shot, the breech block is moved rearwardly by the recoil and the firing hammer is automatically cocked and maintained in the cocked position by a catch pawl (single-action function). For the next shot, when the trigger is actuated by the catch pawl is released and the firing hammer is released for firing.

Many users of such firearms consider this combination of double-action and single-action function, as known in firing-hammer pistols, as a disadvantage because the first shot requires a relatively great trigger force to cock the firing hammer and the subsequent shots are fired with a considerably lower trigger force. Further, for safety reasons, there is also a requirement for automatic pistols that operate only with double-action function and thus require an equally great trigger force for each shot.

The same disadvantages also exist in known hammerless automatic pistols that operate either only with double-action or only with single-action function even though, compared to firing hammer pistols, such hammerless automatic pistols have the advantage that lower masses are moved and fewer parts are required.

EP-PS 77 790 discloses a hammerless automatic pistol with a trigger function that falls between double-action and single-action function. In this known embodiment, the trigger arm is provided with a stop that interacts with a driver of the firing pin. The starting position of the stop is provided at an intermediate position in the path of movement of the firing pin so that the firing pin is partially cocked. As a result, for the first shot with cocked firing, and for all subsequent shots the same trigger force is always required. Thus, this hammerless automatic pistol involves not a real double-action and single-action function, but a trigger function which lies between both these types of operation.

SUMMARY OF THE INVENTION

It is therefore the principal object of the present invention to provide a novel and improved trigger mechanism for a hammerless automatic pistol.

It is another object of the present invention to provide a hammerless automatic pistol that incorporates both the combination of double-action and single-action function as well as only double-action function.

It is a further object of the present invention to provide such a hammerless automatic pistol that is readily acceptable to the requirements and standards of the users of such firearms and incorporates a simple structure which can be modified or adapted for either single-action or double-action operation.

In order to achieve the objects of the present invention and to overcome the disadvantages of the prior art, the hammerless automatic pistol of the present invention is provided with one or more intermediate elements between the firing pin and the trigger arm that can be engaged and that make it possible to have, besides the double-action function, also a single-action function. With the combined double-action and single-action function type of operation, the engagement and disengagement of the intermediate elements is performed automatically during the shooting procedure.

According to one aspect of the present invention, the intermediate elements in the trigger mechanism between the firing pin and the trigger arm may comprise a pivotally mounted support lever which is engageable by the trigger arm and a pivotally mounted spring loaded catch pawl which is engageable by the firing pin to maintain the firing pin in a cocked position during single-action operation. The support lever has a support cam positioned under a projection of the catch pawl to maintain the pawl in engagement with the firing pin.

The adaptation of double-action and single-action function to only double-action function, or visa versa, may be performed by removing or inserting certain ones of the intermediate elements into an operative mode. The removing or inserting of these intermediate elements can be performed manually by an actuation element mounted on the firearm for limited vertical movement.

Among the advantages achieved by the trigger mechanism according to the present invention is the possibility of having double-action and single-action functions in hammerless automatic pistols. Further, the automatic pistol can be simply modified alternately from double-action and single-action function to only double-action function and visa versa. Thus in practice, the various desires of the users of the firearm are taken into consideration and the adaptation of the pistols are increased. A further advantage is the standardization and economic production of such a trigger mechanism as well as a simplification and decrease in inventory and spare parts required. Further, the construction according to the present invention significantly reduces the number of components in the trigger mechanism compared to other known structures.

BRIEF DESCRIPTION OF THE DRAWINGS

Other objects and advantages of the present invention will be apparent upon reference to the accompanying description when taken in conjunction with the following drawings, which are exemplary, wherein.

DESCRIPTION OF THE PREFERRED EMBODIMENTS

Proceeding next to the drawings wherein like reference symbols indicate the same parts throughout the various views, a specific embodiment and modifications of the present invention will be described in detail.

Figure 1:
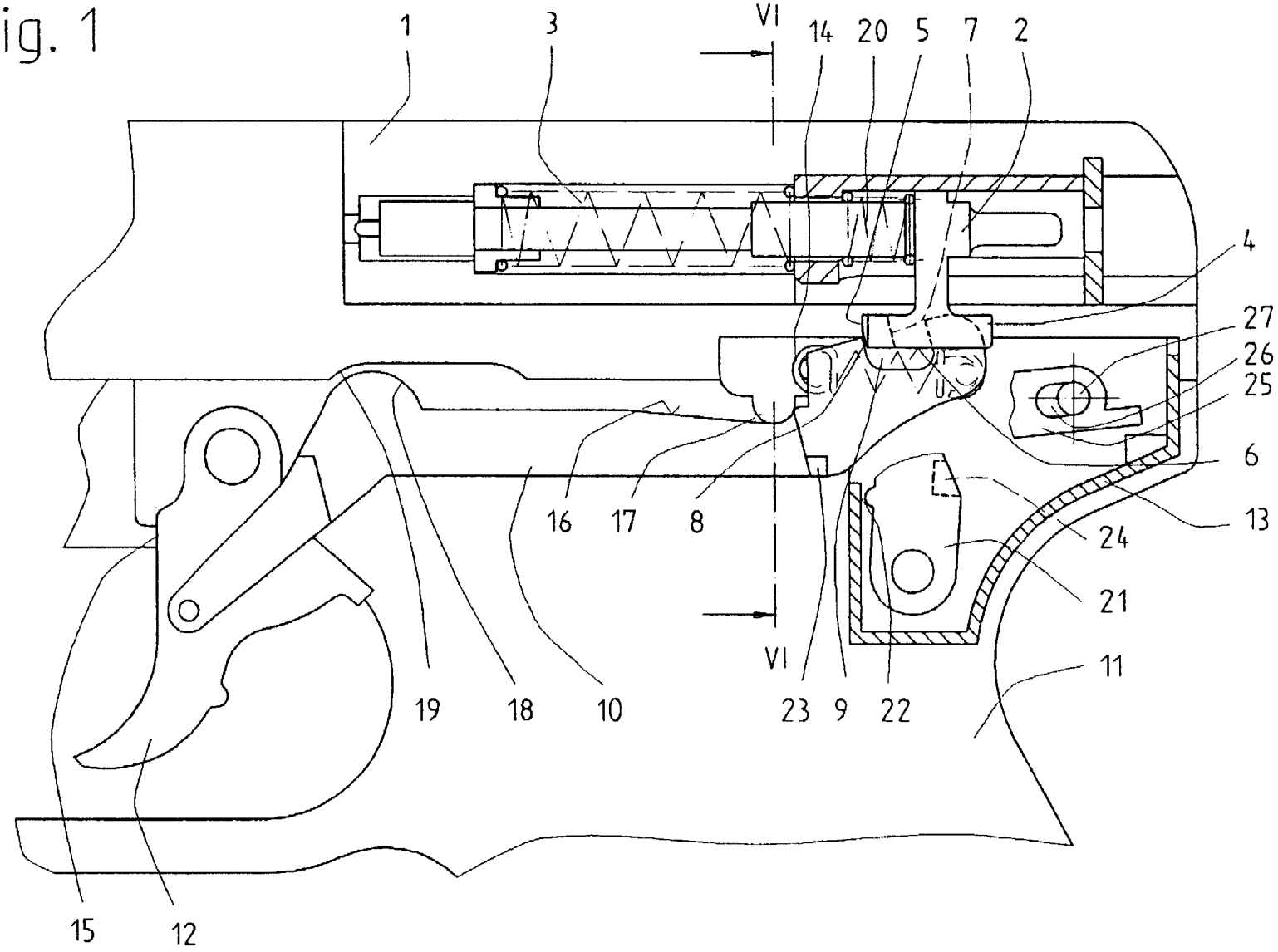
FIG. 1 is a side elevational view of the trigger mechanism according to the present invention at the beginning of double-action function (cocked firing)

As may be seen in FIG. 1, the trigger mechanism of a hammerless automatic pistol is in the starting position for double-action function (cocked firing). The illustrated rear portion of the automatic pistol shows a breech block 1 in which there is mounted for axial displacement a firing pin 2 which moves against the force of a firing pin spring 3. Depending downwardly from the firing pin 2 is a driver element 4 having a forward stop face 5, a lower stop face 6 and a rear stop face 7. The forward stop face 5 is engageable with a forward bearing area 8 of a catch device 9 in the form of an notch or recess on the upper edge of the trigger arm 10 that is moveable in the longitudinal direction of the pistol. The trigger arm 10 has a front end which is pivotally connected to a trigger finger 12 that is pivotally mounted in the stock 11 of the pistol. A tension spring 14 is attached on the rearward end of the trigger arm 10 within a trigger housing 13 and is tensioned to pull the finger arm 10 and trigger 12 forwardly until the trigger 12 comes to rest against a stop 15 within the trigger guard extending from the stock 11. In addition, the trigger arm 10 is urged upwardly by the tension spring 14 such that a leading edge 16 on the upper surface of the trigger arm 10 is urged against a control projection 17 mounted on the trigger housing 13. In the frontal or forward portion of the trigger arm 10 there is a control cam 18 that interacts with a control curve 19 formed on the bottom surface of the breech 1. During rearward movement of breech block 1, the control curve 19 will engage control cam 18 on the trigger arm 10 which is thus moved downwardly. A return spring 20 maintains the firing pin 2 in the rest position.

Figure 2:
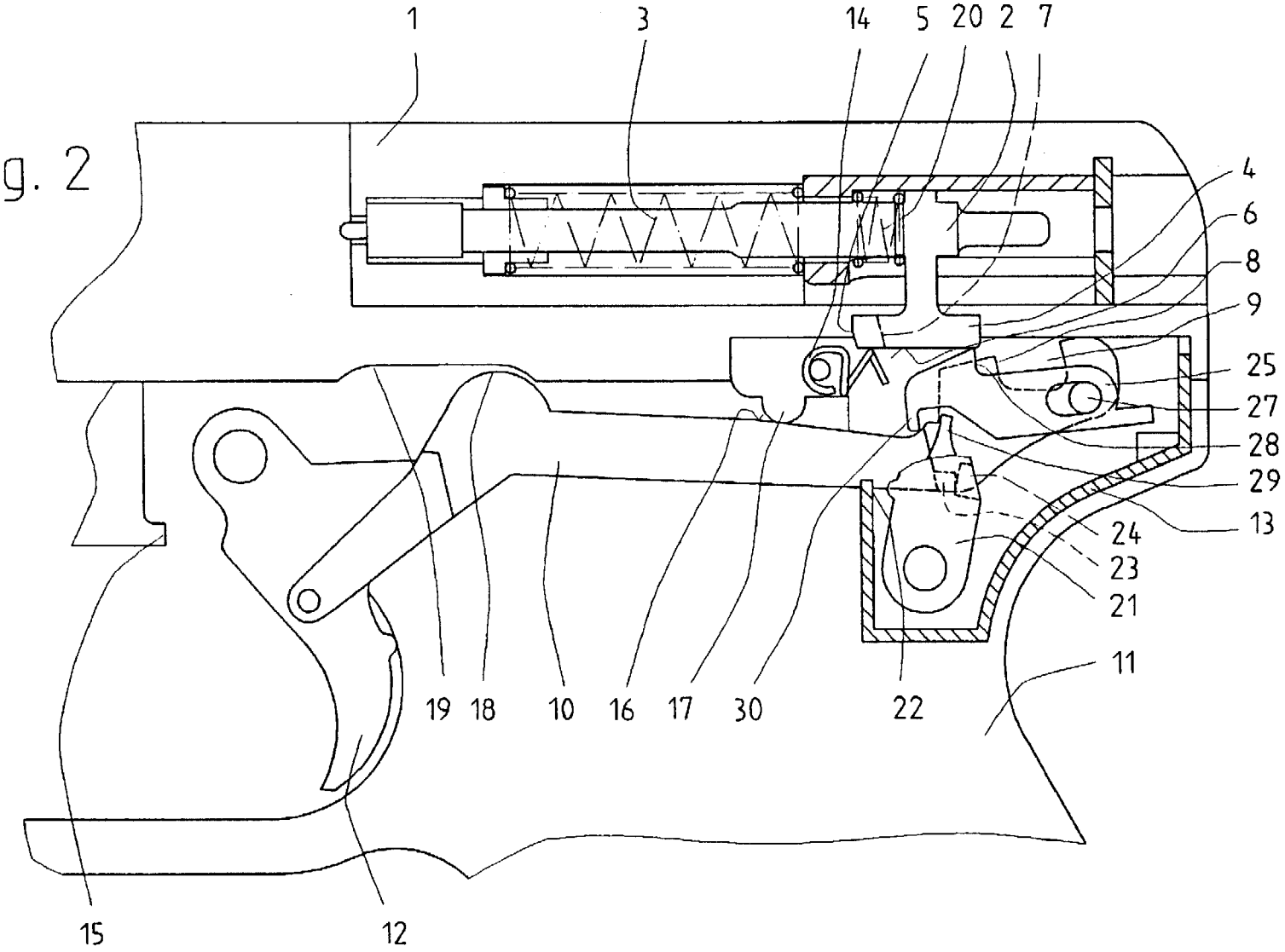
FIG. 2 is a view similar to that of FIG. 1 but at the end of the double-action function when the shot has been fired.

In the rearward area of the trigger arm 10, a support lever 21 is pivotally mounted in the trigger housing 13 and is biased by a spring (not shown) in a counterclock wise direction forwardly against a stop 22 on the trigger housing 13. A laterally extending driving post 23 on the side of trigger arm 10 interacts, in the upper position of trigger arm 10 as shown in FIGS. 1 and 2, with a stop cam 24 on the support lever 21. A catch pawl 25 for the firing pin 2 is pivotally mounted in the trigger housing 13 and is provided with an elongated hole 26 which extends substantially horizontally and has a bearing pin 27 passing there through. The bearing pin 27 is fixed to the trigger housing 13. The elongated opening 26 is required solely for the installation of the catch pawl 25. By means of a spring (which is not shown) the catch pawl 25 is urged upwardly such that a catch nose 28 on the upper surface of the catch pawl 25 contacts the lower stop face on driver element 4 of the firing pin 2. A support cam 29 on the support lever 21 is positioned rearwardly of a downward projection 30 of the catch pawl 25 as may be seen in FIG. 2.

In order to fire the first shot by cocked firing with the components in a position as shown in FIG. 1, the trigger finger 12 which is positioned in its extreme forward position against stop 15 is pulled rearwardly completely by the finger of the user in the normal manner. During this movement of the trigger finger 12, the bearing surface 8 on trigger arm 10 which is in contact against the forward stop face 5 of driver 4 moves the driver and firing pin rearwardly and thus cocks the firing pin spring 3. Just before the rear cocked position of firing pin 2 is reached, the trigger arm 10 is pressed downwardly by the control projection 17 until the bearing area 8 is separated from the stop face 5 of the driver which then releases the firing pin 2 for firing and the firing pin strikes the cartridge in the chamber such that the components are in the position shown in FIG. 2.

Figure 3:
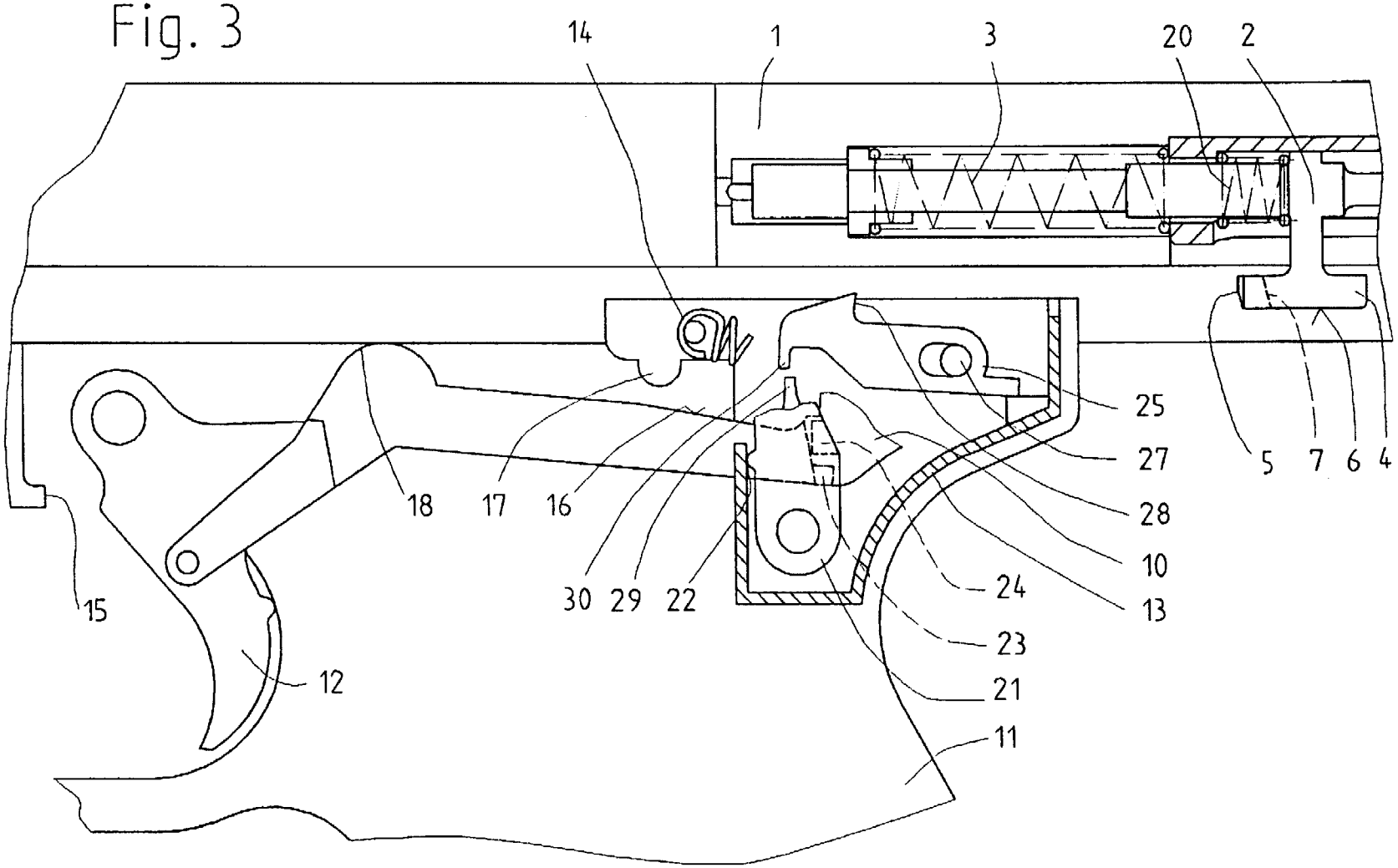
FIG. 3 is a view similar to that of FIG. 2 after successful firing of the shot and showing the breech block in the rear position.

After successful firing of the cartridge, the breech 1 with the uncocked firing pin 2 will be moved rearwardly because of recoil into the rear position shown in FIG. 3. During this movement of the breech block the lower stop face 6 on the driver 4 on the firing pin 2 will move across the catch nose 28 on the catch pawl 25 such that it is then released upwardly into the catch position. It can be further seen in FIG. 3 that when breech block 1 moves rearwardly, the trigger arm 10 will move downwardly because of the control curve 19 acting upon the control cam 18 and the lateral driving post 23 of trigger arm 10 will be separated from stop cam 24 on support lever 21. Thus, support lever 21 under the pressure of its spring can pivot forwardly in a counterclock wise direction to rest against stop 22 on the trigger housing 13. As a result of this movement, the support cam 29 on the upper portion of the support lever 21 will be positioned under projection 30 on the catch pawl 25 which will thus be maintained in the catch position.

After the breech block 1 reaches its rearward position as shown in FIG. 3, breech block 1 will slide forwardly again under the pressure of a breech block closing spring which is not shown. During this forward movement of the breech block 1, forward stop face 5 on the driver 4 of the firing pin 2 will contact the catch nose 28 of the catch pawl 25 which is now in the catch position so that upon further counter recoil movement of breech block 1, the firing pin spring 3 will be compressed and firing pin 2 will be cocked and maintained in the cocked position by the catch pawl 25 (see FIG. 4).

Figure 4:
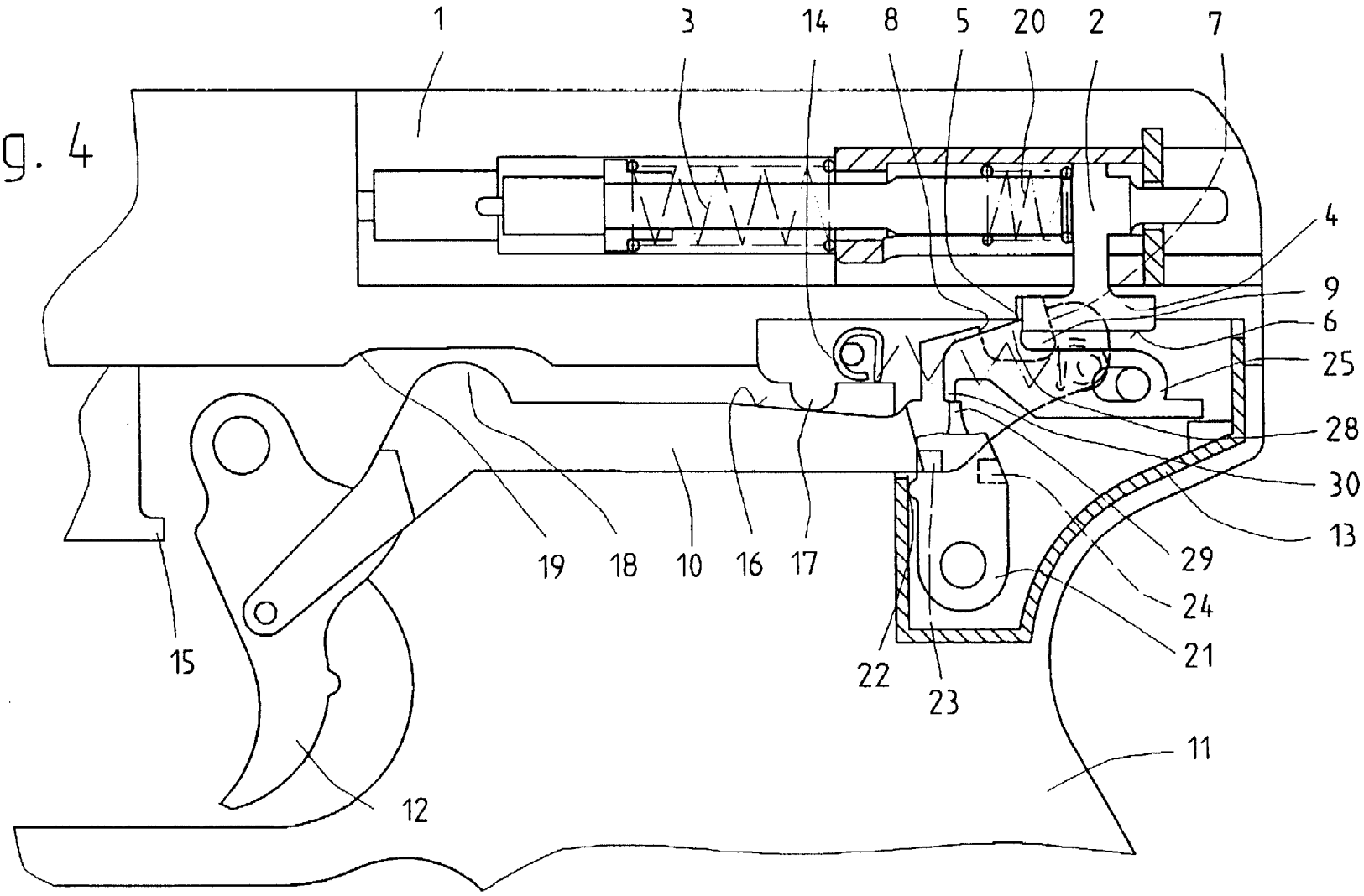
FIG. 4 is a view similar to that of FIG. 1 but at the beginning of single-action function.
Figure 5:
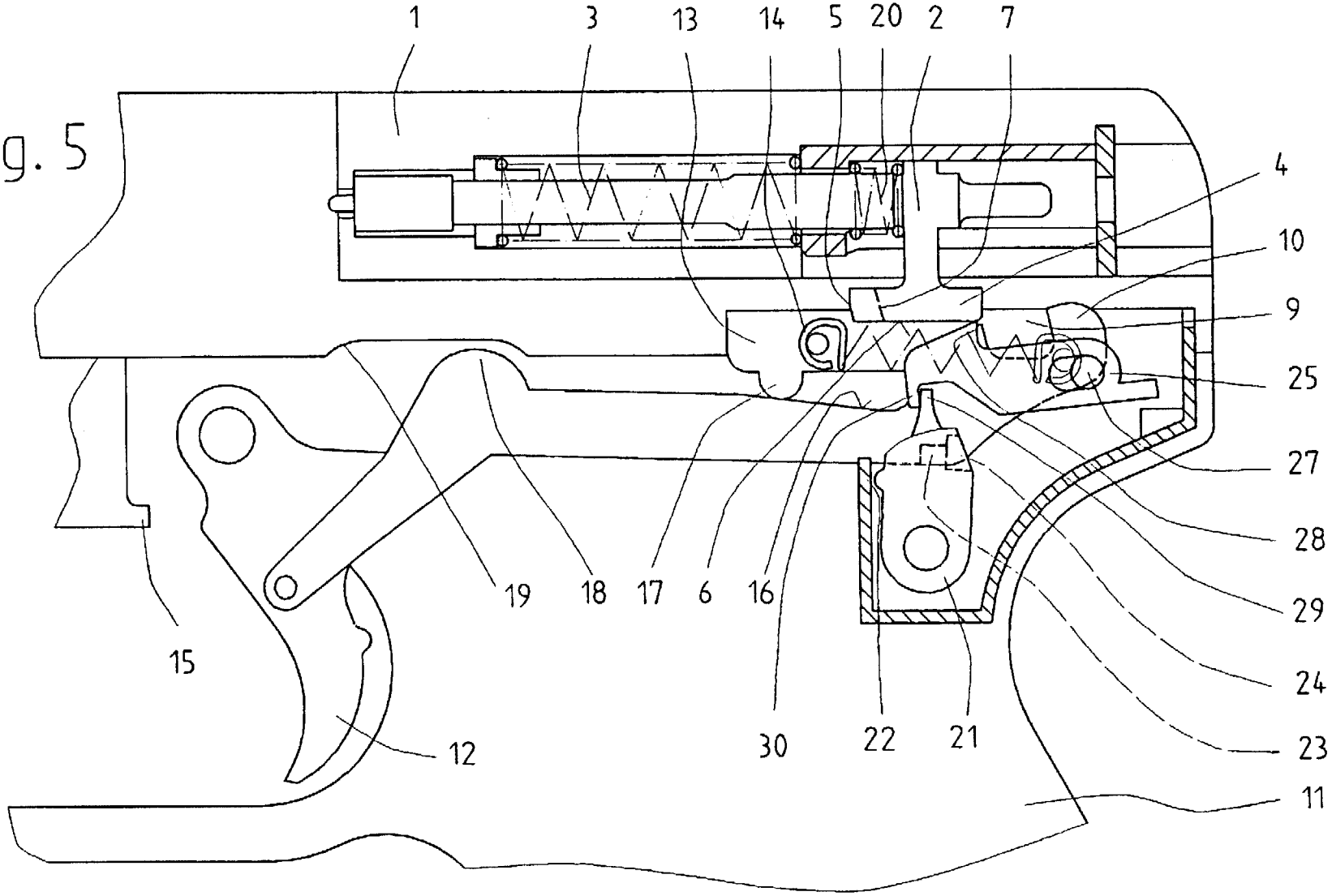
FIG. 5 is a view similar to that of FIG. 1 but at the end of the single-action function.
Figure 6:
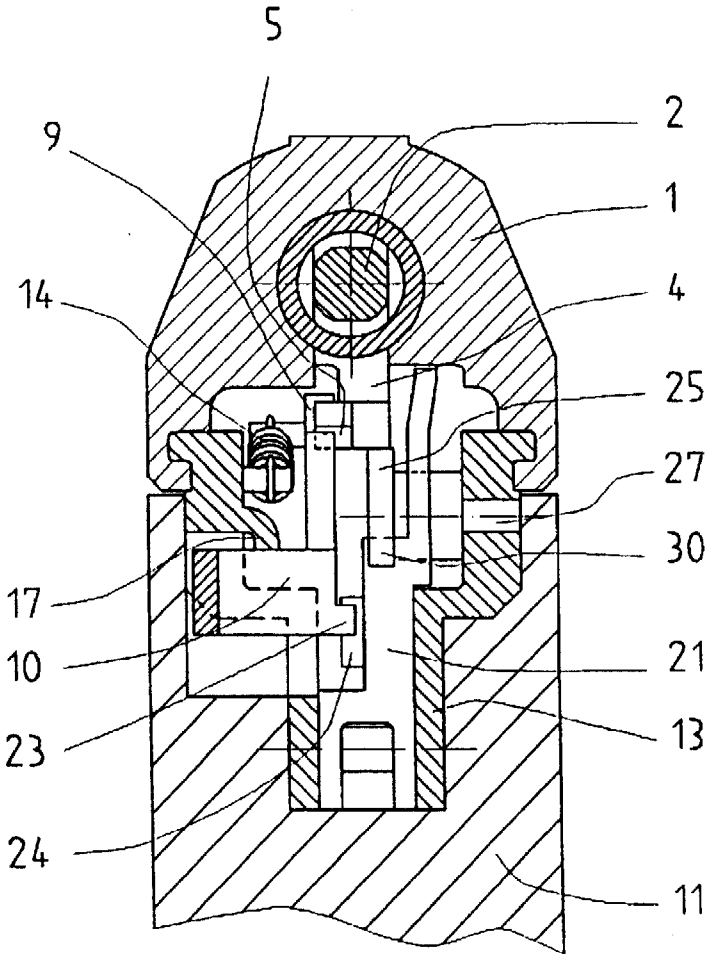
FIG. 6 is a sectional view through the trigger mechanism taken along the line VI—VI of FIG. 1.

After the user releases trigger finger 12, the trigger arm 10 will move forwardly under the force exerted by tension spring 14 and will also move upwardly since the control cam 18 is disengaged from the control curve 19 and the trigger arm 10 is then pulled upwardly against control projection 17. The forward movement of trigger arm 10 is stopped when its catch device 9 contacts the rear stop face 7 of driver 4 of firing pin 2. The trigger finger 12 will now be in the starting position as shown in FIG. 4 for the beginning of single-action function. To fire a shot, the trigger finger 12 is pulled rearwardly until driving post 23 on the trigger arm,contacts stop cam 24 on the support lever 21 to take up slack in the trigger. Continued rearward pressure on the trigger finger 12 will pivot the support lever 21 clockwise and the catch pawl 25 will be released so that firing pin 2, by the force exerted by the firing pin spring 3 is driven forwardly and fires the bullet. The position of the trigger mechanism at the moment of the forward movement of the firing pin 2 is shown in FIG. 5. As a result of the subsequent rearward movement of breech block 1 due to recoil, the movements of the components as described above beginning in FIG. 2 is repeated until the trigger mechanism has again reached the starting position of FIG. 4 for the next successive single-action function.

Figure 7:
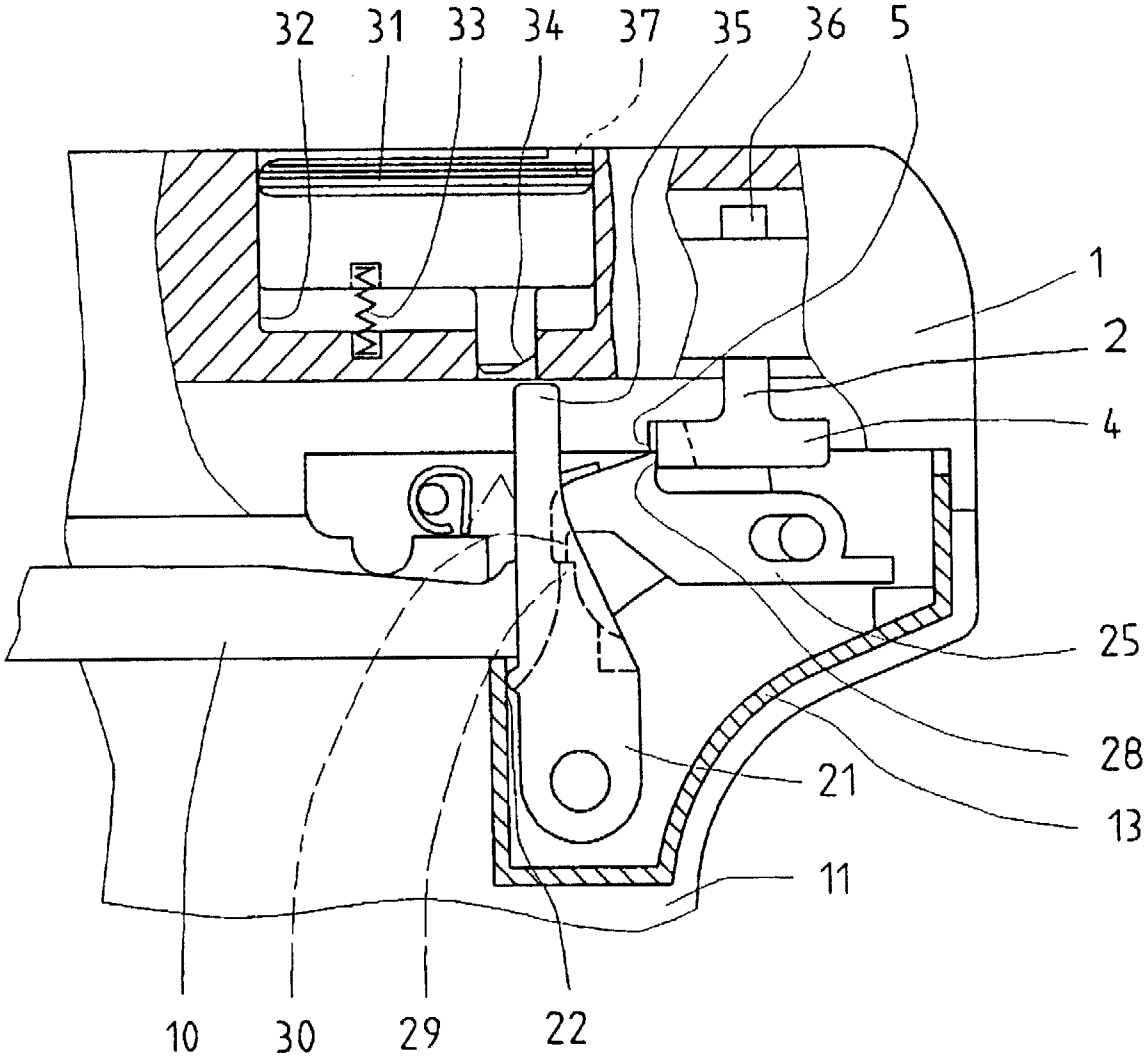
FIG. 7 is a view similar to that of FIG. 1 but showing only the rear portion of the trigger mechanism with an uncocking device for the firing pin.
Figure 8:
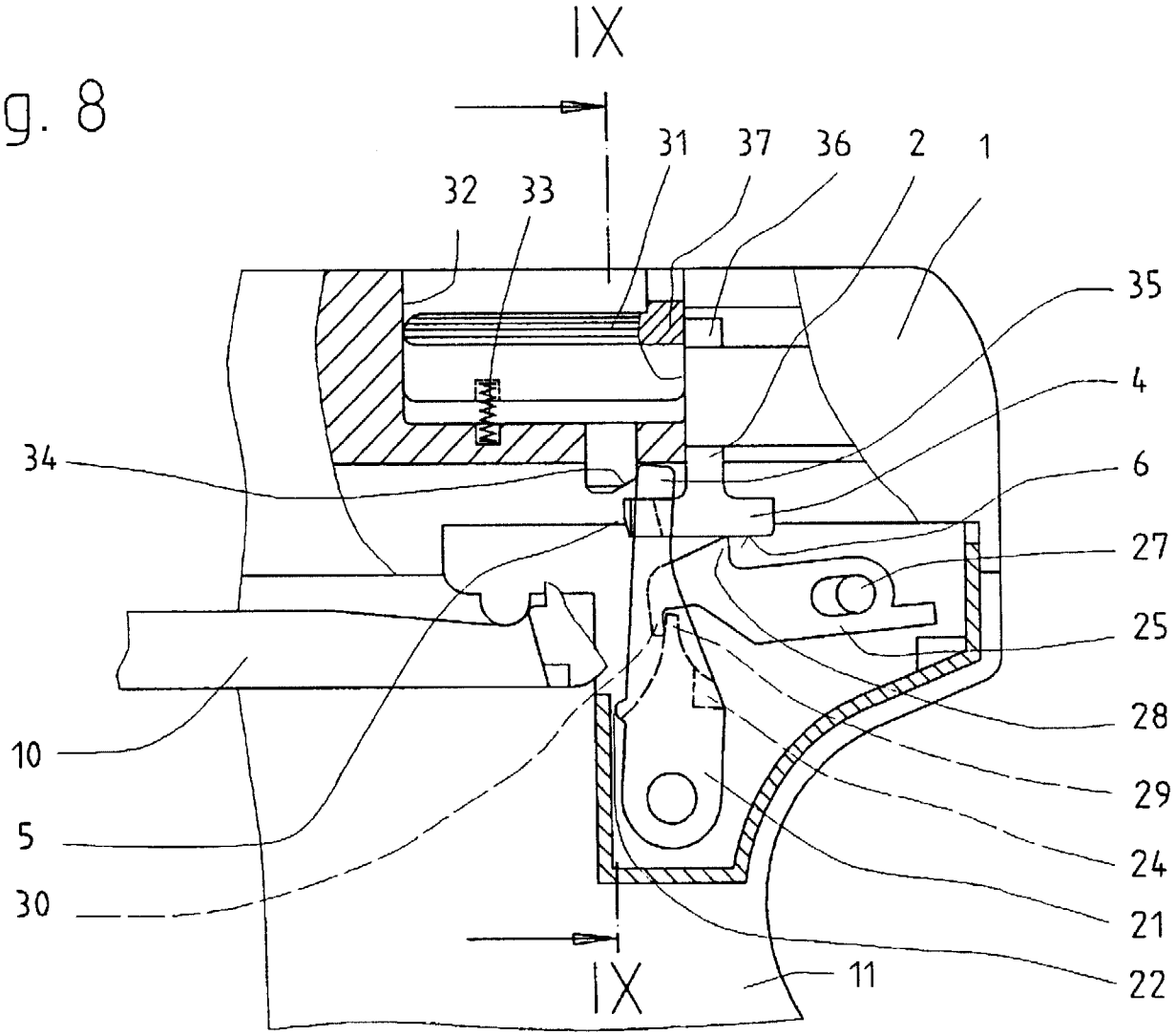
FIG. 8 is a view similar to that of FIG. 7 but showing the uncocking device in the actuated state.
Figure 9:
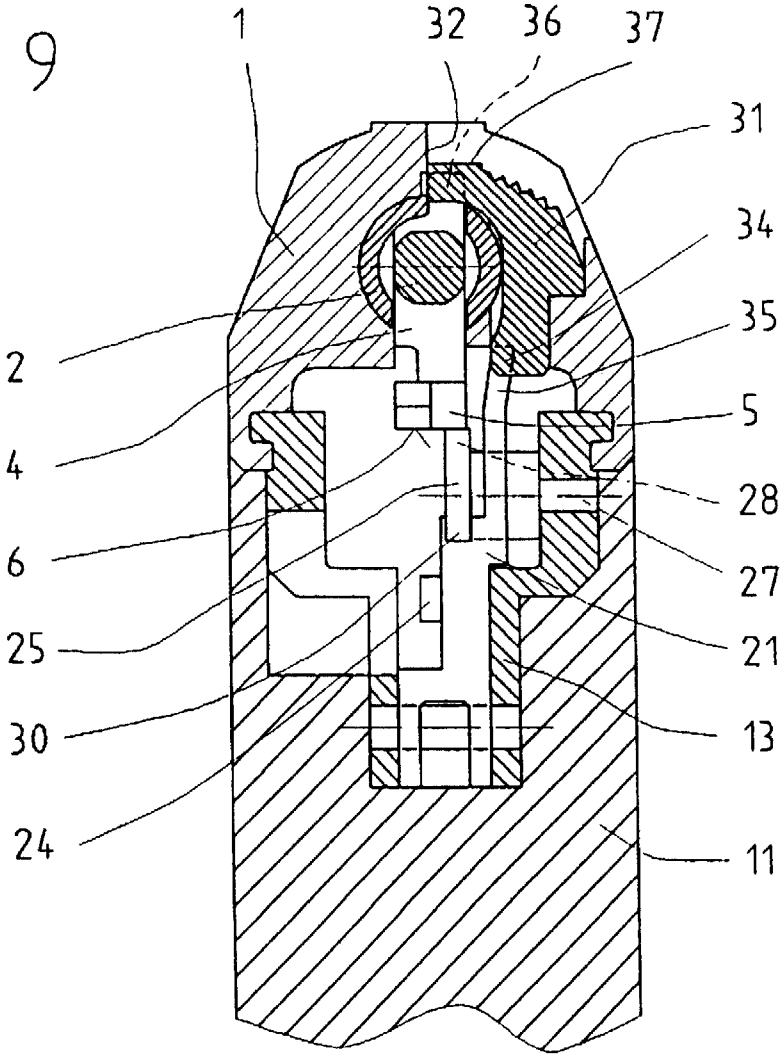
FIG. 9 is a sectional view taken along the line IX—IX of FIG. 8 and showing the uncocking device.

In order to bring the trigger mechanism into the starting position for the beginning of the double-action function as shown in FIG. 1, the cock firing pin 2, starting from the position of the trigger mechanism according to FIG. 4, must first be uncocked. For this purpose, a manual actuation device is provided that is shown in FIGS. 7–9. In the rear portion of breech block 1 an uncocking finger 31 is slideably positioned in a vertical slot 32 formed in the breech block 1. A spring 33 maintains the uncocking finger 31 in the upper position as shown in FIG. 7. Extending from the bottom of the uncocking finger 31 there is a sloping control surface 34 which when uncocking finger 31 is depressed will engage the rounded upper end 35 of support lever 21. By depressing the uncocking finger 31, the control surface 34 will contact upper end 35 of support lever 21 which will then be pivoted clockwise and will no longer support the catch pawl 25 as shown in FIG. 8. The catch pawl 25 will then move downwardly due to the force of firing pin spring 3 and will release driver 4 of the firing pin 2. The cocked firing pin 2 thus can move forward a short distance until, because of safety reasons, an upper nose 36 on the driver 4 will engage a stop 37 on the uncocking finger 31 and will be maintained in position as shown in FIGS. 8 and 9.

By releasing the uncocking finger 31, the firing pin 2 is again released in the upper position of the uncocking finger 31 since stop 37 is located outside of the path of movement of nose 36. At the end of the forward movement, the firing pin 2 will strike the known automatic safety as generally found on automatic pistols which will prevent an undesired firing of a shot. The stopping of firing pin 2 in the depressed state of uncocking finger 31 represents an additional safety feature that takes away from the firing pin the energy necessary to fire a bullet if for any reason the automatic safety should fail.

Figure 10:
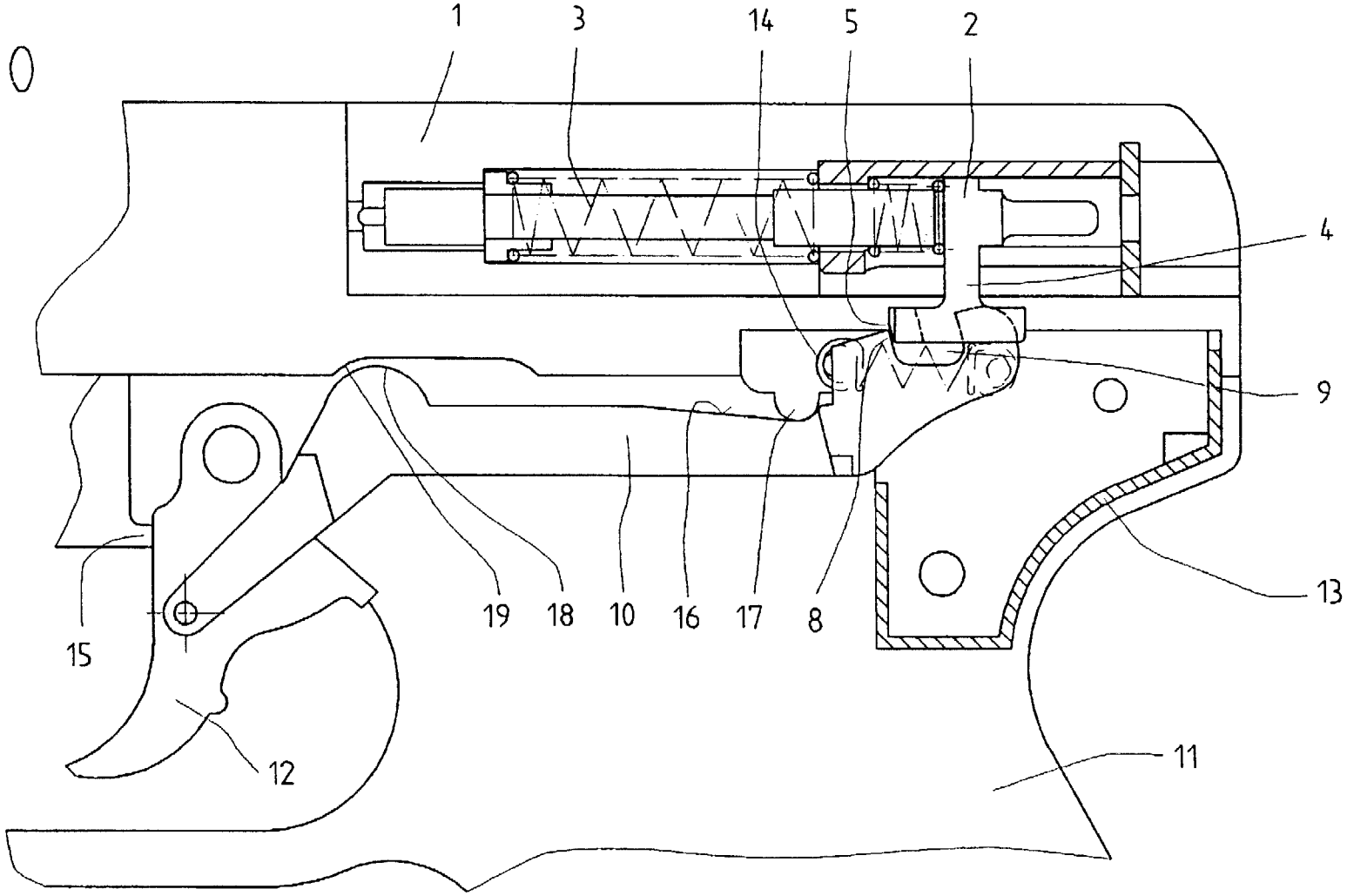
FIG. 10 is a view similar to that of FIG. 1 and showing the trigger mechanism of an embodiment incorporating only a double-action function.

In FIG. 10 there is shown a modification of the trigger mechanism in which the support lever 21 and the catch pawl 25 are eliminated. These components are so constructed that the bearing pins of the support lever 21 and catch pawl 25 can be pushed through and removed with a common tool so that both of these components can be removed from trigger housing 13 without being replaced. As a result of removing these components, it is now possible to have a trigger function in which the cocking of the firing pin 2 is performed exclusively by actuating trigger finger 12 (double-action only). The trigger mechanism will function in the same manner as described in connection with FIGS. 1 and 2. However, after firing of the cartridge as shown in FIG. 2, the firing pin 2, during the rearward and forward movement of the breech block 1 will not be caught and cocked because support lever 21 and catch pawl 25 are not present. Rather, the firing pin is again brought into the starting position as seen in FIG. 1. By replacing the support lever 21 and catch pawl 25 the automatic pistol can again be adapted to combine double-action and single-action trigger functions.

It is also possible to leave the support lever 21 in the pistol and this will not interfere in double-action only (DAO). For such a DAO function, it is sufficient simply to remove the catch pawl 25.

In another modification which is not illustrated, the support lever 21 and catch pawl 25 can be pivoted by an actuation lever attached on the outside of the firearm in such a position that these components are outside of the radius of action of trigger arm 10 and firing pin 2 so as to maintain the trigger function of "double-action only". By setting such an actuation lever back into the starting position, the support lever 21 and catch pawl 25 are again engaged to achieve combined double-action and single-action trigger functions.

Thus it can be seen that the present invention has provided a novel but simplified trigger mechanism for hammerless automatic pistols such that the pistol is capable of both double-action function and single-action function.

It will be understood that this invention is susceptible to modification in order to adapt it to different usages and conditions, and accordingly, it is desired to comprehend such modifications within, this invention as may fall within the scope of the appended claims.

What is claimed is:

1. A trigger mechanism for hammerless hand firearm comprising a trigger housing, a trigger pivotally mounted in a stock of the firearm, a trigger arm within said trigger housing and connected to and actuated by said trigger, an axially displaceable spring-loaded firing pin and a catch pawl to hold said firing pin in a cocked position, a support lever between said catch pawl and said trigger arm, said support lever engageable with and maintaining said catch pawl in a position for single-action operation and is disengageable for double-action operation.

2. A trigger mechanism as claimed in claim 1 wherein said support lever is engageable and disengageable automatically during the combined double-action and single-action operation.

3. A trigger mechanism for a hammerless hand firearm comprising a trigger housing, a trigger pivotally mounted in a stock of the firearm, a trigger arm within said trigger housing and connected to and actuated by said trigger, an axially displaceable spring-loaded firing pin, and means comprising at least one intermediate element engageable between said firing pin and said trigger arm for providing both double-action and single-action operation of the firearm, said intermediate element means is engageable and disengageable automatically during the combined double-action and single-action operation, and further comprising means for removing or inserting said intermediate element means to adapt from double-action and single-action function to only double-action operation and visa versa.

4. A trigger mechanism as claimed in claim 3 wherein said means for removing or inserting comprises a manually actuable element on said firearm.

5. A trigger mechanism for a hammerless hand firearm comprising a trigger housing, a trigger pivotally mounted in a stock of the firearm, a trigger arm within said trigger housing and connected to and actuated by said trigger, an axially displaceable spring-loaded firing pin, and means comprising at least one intermediate element engageable between said firing pin and said trigger arm for providing both double-action and single-action operation of the firearm, said intermediate element means comprises a support lever pivotally mounted within said trigger housing and an engageable by said trigger arm, a spring loaded catch pawl having a projection thereon and pivotally mounted within said trigger housing and engageable by said firing pin to maintain said firing pin in a cocked position during single-action operation, said support lever having a support cam positionable under said projection of said catch pawl to hold said pawl in engagement with said firing pin.

6. A trigger mechanism as claimed in claim 5 and further comprising a first spring acting against said catch pawl so as to move said catch pawl into the catch position of said firing pin.

7. A trigger mechanism as claimed in claim 6 wherein said catch pawl has a longitudinally extending elongated opening therein to receive there through a pin fixed in said trigger housing.

8. A trigger mechanism as claimed in claim 5 wherein said catch pawl has a catch nose on its upper surface engageable with said firing pin to maintain said firing pin in the cocked position during single-action operation.

9. A trigger mechanism as claimed in claim 8 wherein said firing pin has a driver element which is engageable with said catch nose on said catch pawl.

10. A trigger mechanism as claimed in claim 9 wherein said driver element has a rear first stop face and a second stop face on its underside engageable by said catch pawl so as to maintain said catch pawl out of its catch position when so engaged.

11. A trigger mechanism as claimed in claim 10 wherein said trigger arm has a catch element thereon engageable with said rear first stop face on said driver element of said firing pin.

12. A trigger mechanism as claimed in claim 5 wherein said projection on said catch pawl is downwardly directed toward said support lever and engageable with said support cam on said support lever.

13. A trigger mechanism as claimed in claim 5 wherein said trigger arm has a laterally extending driving part, said support lever further having a stop cam engageable by said driving part when said trigger arm is in an upper position.

14. A trigger mechanism as claimed in claim 13, wherein said stop cam extends laterally from a side of said support lever.

15. A trigger mechanism as claimed in claim 5 and further comprising a manually actuable means for uncocking said firing pin and engageable with said support lever to pivot said support lever to release said catch pawl which in turn releases said firing pin.

16. A trigger mechanism as claimed in claim 15 wherein said manually actuable means comprises a vertically moveable spring-loaded uncocking member having a cam control surface engageable with an upper end of said support lever such that said support lever is pivoted.

17. A trigger mechanism as claimed in claim 16 wherein said vertically moveable uncocking member has a depressed lower position and has a third stop surface thereon, said firing pin having a driver element thereon and there being a fourth stop face on said driver element engageable with said third stop surface when said uncocking member is in its depressed lower position such that forward movement of the firing pin is stopped.

18. A trigger mechanism as claimed in claim 16 wherein said vertically moveable uncocking member has an upper undepressed position such that a third stop surface is disengaged from said driver element and said firing pin is released.

* * * * *